US005526587A

United States Patent [19]

Sartor

[11] Patent Number: 5,526,587

[45] Date of Patent: Jun. 18, 1996

[54] LOCKING DEVICE FOR SPORTS FOOTWEAR, IN PARTICULAR FOR SKI-BOOTS

[75] Inventor: Mario Sartor, Volpago D. Montello, Italy

[73] Assignee: Tecnica SpA, Treviso, Italy

[21] Appl. No.: 407,629

[22] Filed: Mar. 21, 1995

[30] Foreign Application Priority Data

Mar. 31, 1994 [IT] Italy ..... TV94U0016

[51] Int. Cl.[6] ..... A43B 5/04

[52] U.S. Cl. ..... 36/117; 36/119; 36/55; 36/10; 36/50.5

[58] Field of Search ..... 36/117, 118, 119, 36/120, 121, 10, 55, 50.5, 88

[56] References Cited

U.S. PATENT DOCUMENTS

| | | | |
|---|---|---|---|
| 5,065,533 | 11/1991 | Paris | 36/117 |
| 5,177,885 | 1/1993 | Marmonnier | 36/117 |
| 5,279,053 | 1/1994 | Pallatin et al. | 36/10 X |

FOREIGN PATENT DOCUMENTS

| | | | |
|---|---|---|---|
| 0120267 | 10/1984 | European Pat. Off. . | |
| 0248149 | 12/1987 | European Pat. Off. | 36/117 |
| 0521283 | 1/1993 | European Pat. Off. . | |
| 0657115 | 6/1995 | European Pat. Off. . | |
| 3821053 | 1/1989 | Germany | 36/117 |

*Primary Examiner*—Paul T. Sewell
*Assistant Examiner*—Marie Denise Patterson
*Attorney, Agent, or Firm*—Griffin, Butler, Whisenhunt & Kurtossy

[57] ABSTRACT

In a locking device for sports footwear, in particular for ski-boots comprising a body (12) on which a leg-piece (18) is pivotably mounted two levers (24,26) are hinged together at one of their ends and pivotably mounted at their opposite ends on the body (12) and the leg-piece (18) respectively. The lever pivotably mounted on the body (12) is provided with a lug (41) able to engage with an inner shoe (21) so as to prevent it from coming out.

6 Claims, 4 Drawing Sheets

LOCKING DEVICE FOR SPORTS FOOTWEAR, IN PARTICULAR FOR SKI-BOOTS

The present invention relates to an improvement to a locking device for sports footwear, in particular for ski-boots of the type comprising a rigid body having pivotably mounted on it a leg-piece which has the function of surrounding the bottom part of the skier's leg. Furthermore, the boot has inside it a shoe, the purpose of which is to ensure greater wearing comfort, preventing in particular points of contact between the body or leg-piece and the skier's foot.

The locking device is located between the body and the leg-piece and is of the type comprising a first and a second member hinged together at one of their ends. The opposite ends of said first and second member are pivotably mounted on the body and the leg-piece respectively.

BACKGROUND OF THE INVENTION

In particular, the improvement of the present invention is applicable to the locking device illustrated in the co-pending U.S. patent application Ser. No. 08/353,332 which was filed on Dec. 5, 1994 claiming the priority of the Italian Utility Model Application No. TV93U 000056 filed on Dec. 7, 1993 in the name of the same Applicant and will be referred to below for the description of a particular embodiment of the invention.

Such locking devices allow the leg-piece to be inclined backwards, resulting in a dual benefit: the skier is able to extract his/her foot from the boot more easily and able to walk more easily since the leg is able to assume a vertical position with respect to the foot.

However, these devices still have some drawbacks. In fact, even after opening the locking device, the skier still has some difficulties in extracting his/her foot which is completely surrounded by the boot and hence, in an attempt to free the foot from the latter, may also risk pulling out the inner shoe from the boot. This drawback frequently occurs in boots of the so-called "central entry" type where a "rear entry" shoe is combined with a "front entry" body. Extraction of the shoe may cause not a small amount of trouble for the skier in view of the special heavy sports clothing worn which makes his/her movements difficult or awkward.

The aim of the present invention, therefore, is to devise a locking device which makes it possible to overcome the drawbacks mentioned with reference to the cited prior art.

SUMMARY OF THE INVENTION

This aim is achieved by means of a locking device of the aforementioned type characterized in that said first member has a lug extending in a direction substantially opposite thereto with respect to the point in which it is pivotably mounted on the body, said lug, in the open condition of the device, projecting inside the body so as to be able to engage with the inner shoe, preventing it from coming out of the boot.

Thus it can be easily understood that, should the skier wish to take off the boot after obviously opening the locking device, the inner shoe is prevented from coming out, thereby avoiding problems and difficulties for the skier.

In a preferred embodiment of the invention the engagement between the lug of the first member and the inner shoe, in the open condition of the device, is achieved by means of a projecting shoulder on the shoe, designed to engage at the bottom with said lug.

In particular, in the open condition of the locking device, there is relative play between the shoulder of the inner shoe and the lug of the first member such that the inner shoe can lift slightly before engaging with the lug.

As a result it is obvious that, as the skier removes his/her foot from the boot, the shoe lifts and comes out slightly from the body, thus facilitating extraction of the foot without, however, coming out entirely. When the skier has completely removed his/her foot, the shoe is free to return into its original position inside the boot.

BRIEF DESCRIPTION OF THE DRAWINGS

These and further advantageous features of the invention will emerge more clearly from the following detailed description of an embodiment thereof provided by way of a non-limiting example with reference to the following accompanying figures.

DESCRIPTION OF PREFERRED EMBODIMENTS

Figure 1:
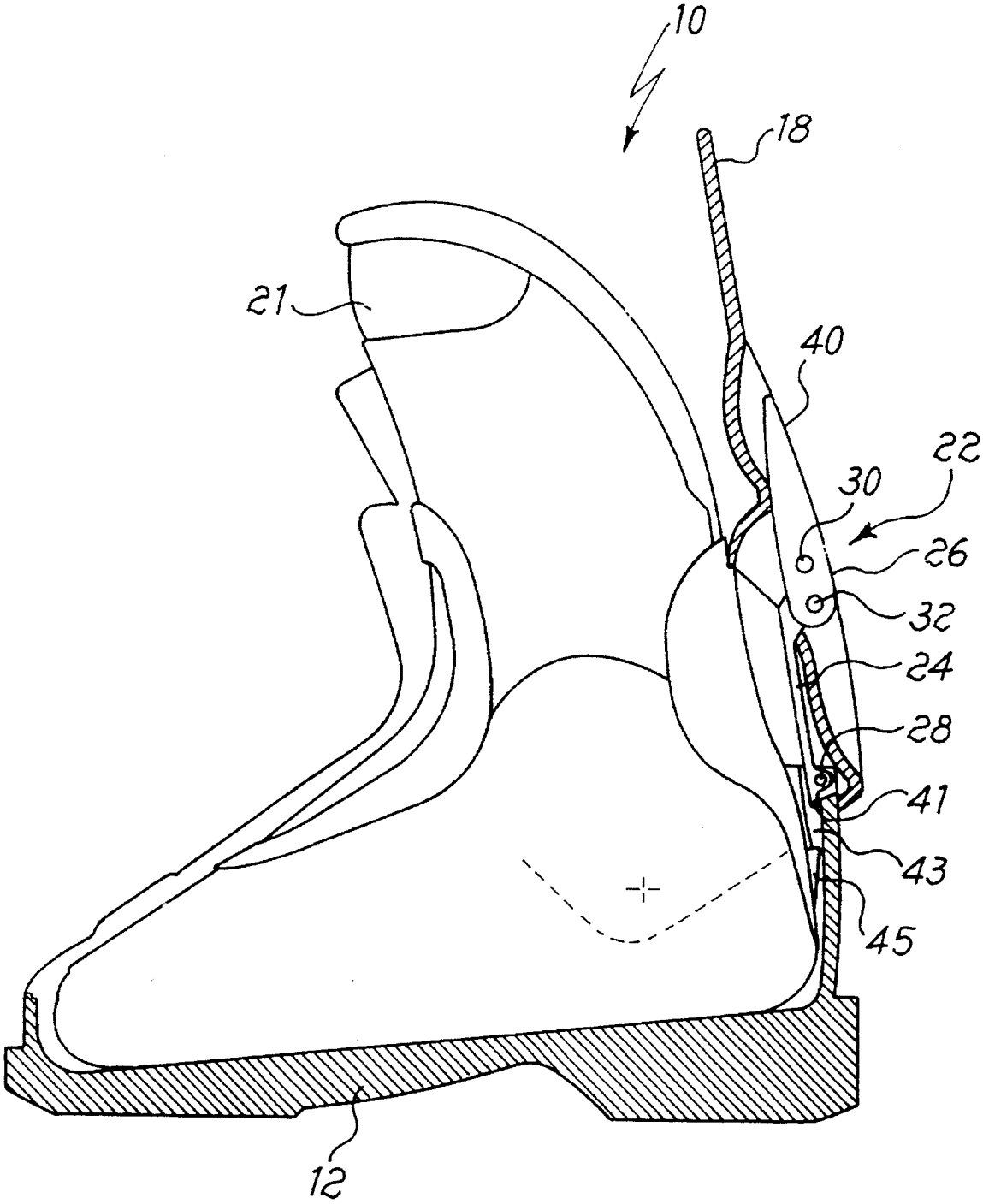
FIG. 1 is a longitudinal section through a ski-boot provided with a locking device according to the present invention shown in the closed position.

The locking device, as already mentioned previously, is similar to the device forming the subject of the aforementioned U.S. patent application in the name of the same Applicant. For the sake of uniformity, in the case of parts which are the same or similar, it has been considered appropriate to use in the present description the same reference numbers as those used in the aforementioned Application.

In FIGS. 1, 2 and 3, 10 denotes in its entirety a ski-boot comprising a rigid body 12, a leg-piece pivotably fixed to the body 12 so as to allow relative rotation between the leg-piece and body about a transverse axis. The boot 10 also has inside it an inner shoe 21 which is suitably lined and has the function of ensuring greater wearing comfort for the skier's foot. A locking device 22 is located between the body 12 and the leg-piece 18, at the rear thereof, so as to allow the leg-piece itself to be separated backwards.

The locking device 22 comprises a first and a second lever each denoted by 24 and 26, respectively, pivotably mounted at one of their ends on the body 12 and the leg-piece 18 by means of respective pins 28 and 30 and hinged with each other at their opposite ends by means of a pin 32. The axes of the pins 28, 30 and 32 are perpendicular to the longitudinal mid-plane of the boot 10 so that the movement of the device occurs substantially in this plane.

In particular, the first lever 24 is extendable telescopically and the second lever 26 is provided with an end-piece 40 extending on the opposite side of the lever itself with respect to the pin 30 for actuating the locking device 22. For a detailed explanation of operation of the locking device 22 reference should be made to the aforementioned Utility Model Application.

Figure 2:
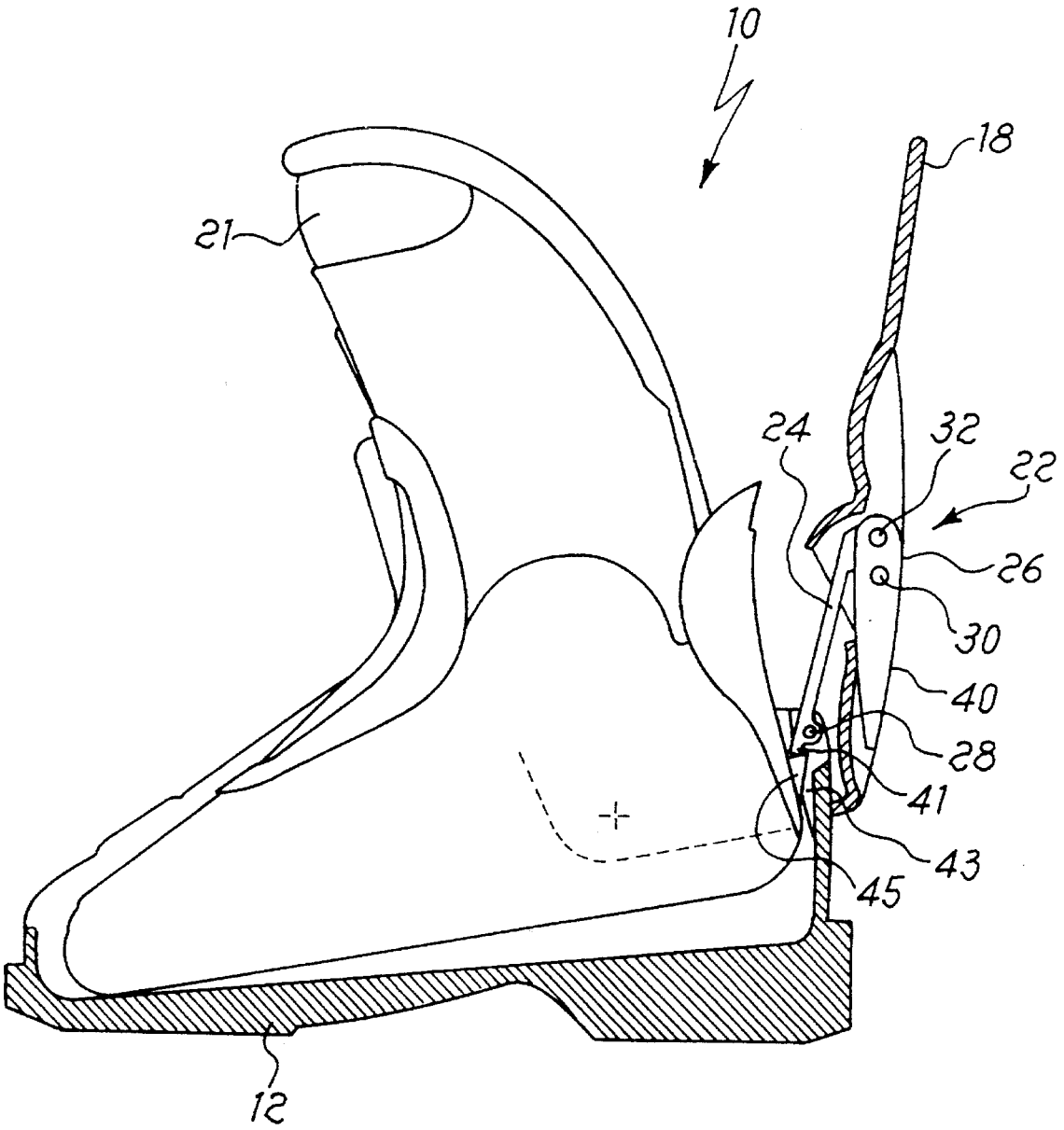
FIG. 2 is a figure similar to FIG. 1 in which said device is shown in the open position.
Figure 5:
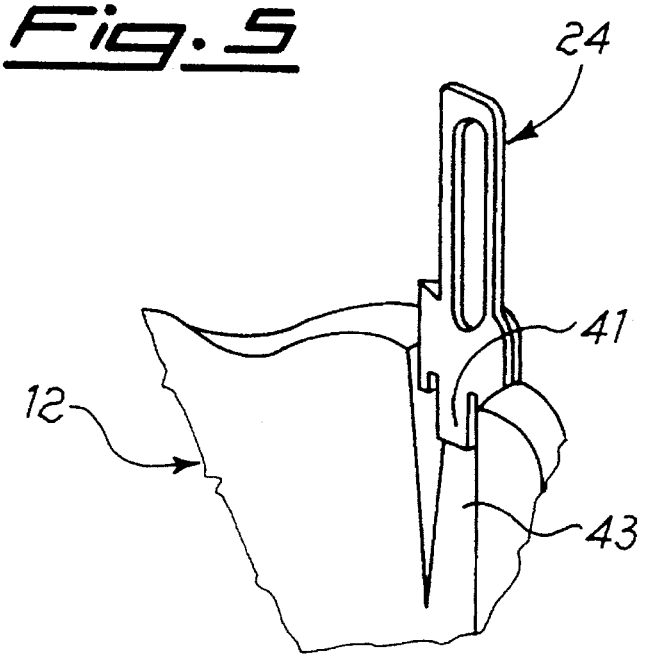
FIG. 5 is a perspective view of a detail of the locking device.

The first lever 24 has a lug 41, more clearly visible in FIG. 5, extending to the opposite side to the lever itself with respect to its pin 28. In order to fully understand the functional nature of the lug 41, it is necessary to emphasize the fact that, with the locking device 22 closed as shown in FIG. 1, the first lever 24 is in a substantially vertical position whereas, with the locking device open as shown in FIG. 2, the same lever is in a position inclined backwards slightly. Consequently, in the first position, the lug 41 is housed inside a seat 43 formed in the body 12 whereas, in the second position, the lug projects towards the inside of the body 12.

Figure 4:
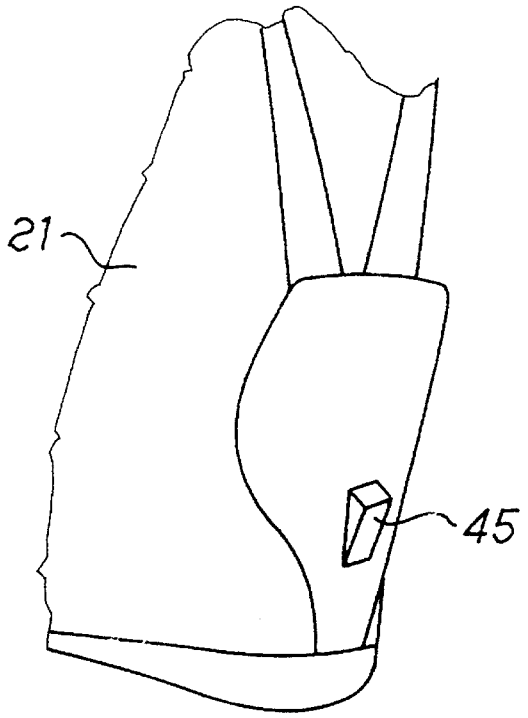
FIG. 4 is a rear perspective view showing part of the inner shoe.

The inner shoe 21 has a shoulder 45, more clearly visible in FIG. 4, situated at the rear and along the longitudinal mid-plane along which the locking device 22 is also located. More precisely the shoulder 45 is situated in a position slightly beneath the lug 41 so as to obtain relative play in the vertical direction between the body 12 and the inner shoe 21.

Figure 3:
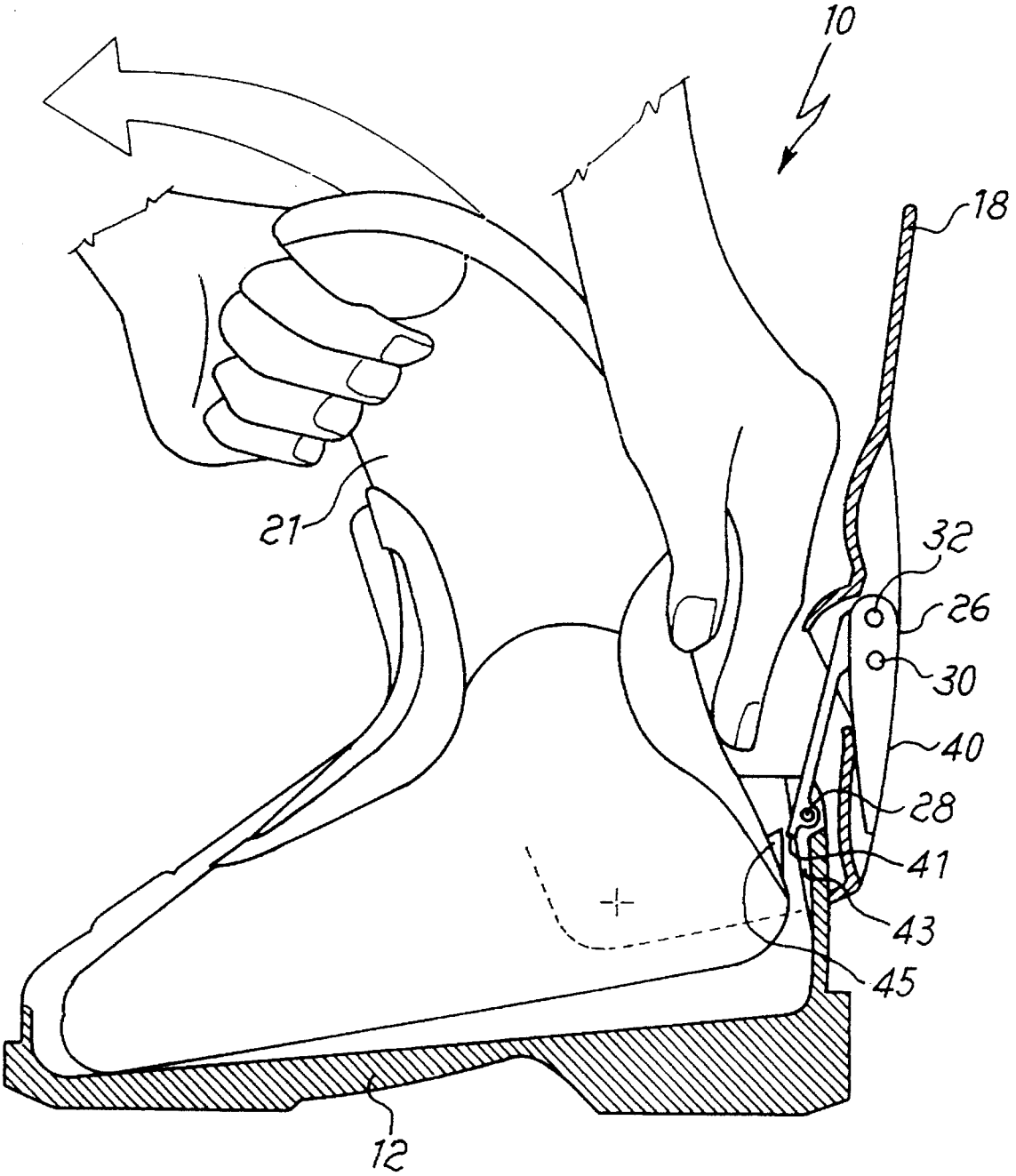
FIG. 3 is a figure similar to FIG. 2 illustrating the manner in which the inner shoe can be removed from the boot.

It can be easily understood that in the released position (FIG. 2) the inner shoe 21 is free to lift slightly until the shoulder 45 comes up against the lug 41 of the locking device 22. In order to remove completely the shoe 21 from the boot 10, it is sufficient to press on the rear of the shoe 21, as shown in FIG. 3, so as to disengage the shoulder 45 from the lug 41, thus allowing the said shoe to be removed entirely.

The present invention therefore offers the skier certain advantages. In fact, during extraction of the foot, the shoe lifts and therefore comes out partially from the boot, facilitating extraction of the foot itself. Moreover, during the same operation, removal of the inner shoe is prevented by engagement of the shoulder present on the shoe with the lug of the locking device.

Finally, it is clearly understood that conceptually equivalent variations or modifications fall within the protective scope of the present invention. For example, instead of a shoulder projecting from the shoe, it is possible to provide a recess inside which the lug of the locking device can slide until it comes up against one end thereof when the shoe is raised slightly with respect to the boot.

I claim:

1. In sports footwear having a rigid body, a leg piece pivotably mounted on the rigid body such that the leg piece is pivotable from a closed position with respect to the body to an opened position with respect to the body, an inner shoe disposed in the body and within the leg piece for receiving a foot of a wearer, a locking device disposed between the body and the leg piece for locking the leg piece in the closed position and for pivoting the leg piece to the opened position, said locking device having a first member and a second member hinged to each other at ends thereof and an opposite end of the first member being pivotably mounted on the body and an opposite end of the second member being pivotably mounted on the leg piece, the improvement comprising:

a lug extending from the opposite end of the first member such that when the leg piece is in the opened position the lug projects into the body and engages the inner shoe sufficiently to prevent the inner shoe from coming out of the footwear when the foot of the wearer is removed from the inner shoe.

2. Sports footwear according to claim 1, wherein the engagement between the lug and the inner shoe is by means of a shoulder projecting from the inner shoe.

3. Sports footwear according to claim 2, wherein in the opened position there is relative play between said shoulder and said lug such that the inner shoe is slightly liftable before engaging the lug.

4. Sports footwear according to claim 1, wherein the locking device is located at the rear of said body and leg-piece.

5. Sports footwear according to claim 1, wherein in the closed position said lug is substantially contained inside a seat formed in the body.

6. Sports footwear according to claim 1, wherein the sports footwear is a ski-boot.

* * * * *